United States Patent [19]

Brack et al.

[11] 4,148,510

[45] Apr. 10, 1979

[54] HAND OPERABLE SCOOP FOR THE COLLECTION AND DISPOSAL OF ANIMAL EXCREMENT

[75] Inventors: Patrick Brack, 145 E. 23 St., New York, N.Y. 10010; Arnold S. Brack, Grandview, Mo.

[73] Assignee: Patrick Brack, New York, N.Y.

[21] Appl. No.: 852,547

[22] Filed: Nov. 17, 1977

[51] Int. Cl.[2] ..... A47F 13/52

[52] U.S. Cl. ..... 294/1 R; 294/55

[58] Field of Search ..... 294/1 A, 16, 19 R, 25, 294/33, 55, 99 R; 15/257.1, 257.6; 119/1 R; 228/3.5

[56] References Cited

U.S. PATENT DOCUMENTS

| | | | |
|---|---|---|---|
| 3,685,088 | 8/1972 | Doherty | 294/1 R |
| 3,837,696 | 9/1974 | Dahlke | 294/1 R |
| 3,847,597 | 12/1974 | Young | 294/1 R |
| 3,848,906 | 11/1974 | Fleishman | 294/1 R |
| 4,014,584 | 3/1977 | Bau | 294/1 R |

*Primary Examiner*—James B. Marbert
*Attorney, Agent, or Firm*—Steven H. Bazerman

[57] ABSTRACT

A container is formed from a pair of concave shell halves with each shell half having a small upper portion and a lower portion which is larger than the upper portion. The shell halves are connected by an integral hinge at their respective upper portions. The smaller upper portions are sized to be easily received in and encompassed by the fingers of a user. The lower portions are provided with straight edges which are disposed remote from the integral hinge. The shell halves are constructed so that they can be manipulated from their normally biased open, i.e., spread apart configuration to a closed configuration about animal excrement. As the shell halves are so manipulated the straight edges scrape the animal excrement into the container. In one embodiment when the shell halves are in their closed configuration the straight edges are in telescoping relationship and a locking structure is provided along at least the straight edges to lock the shell halves in their closed relationship thereby effectively sealing the container. In an alternative embodiment, the straight edges, when the shell halves are in the closed configuration, abut each other and a locking structure disposed on the edges of the shell halves locks the shell halves in their closed relationship.

5 Claims, 7 Drawing Figures

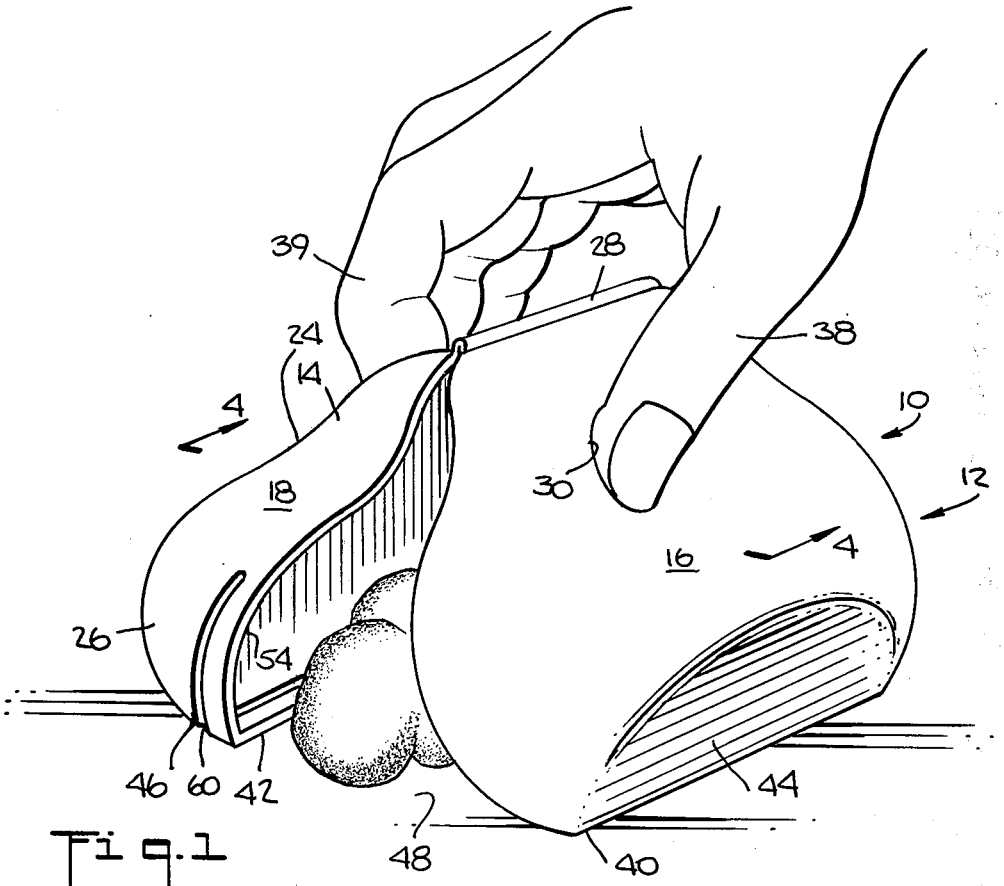
Fig. 1
Fig. 2.
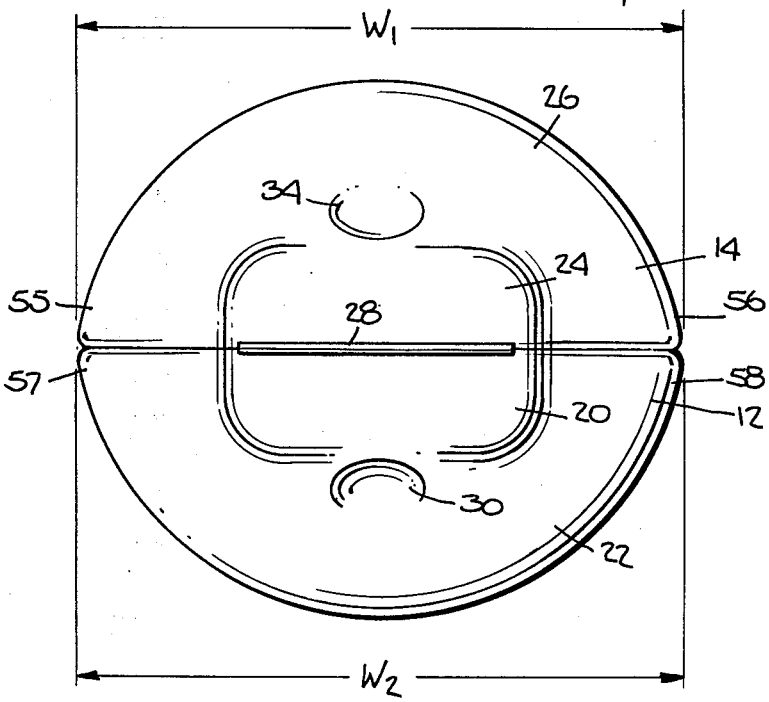

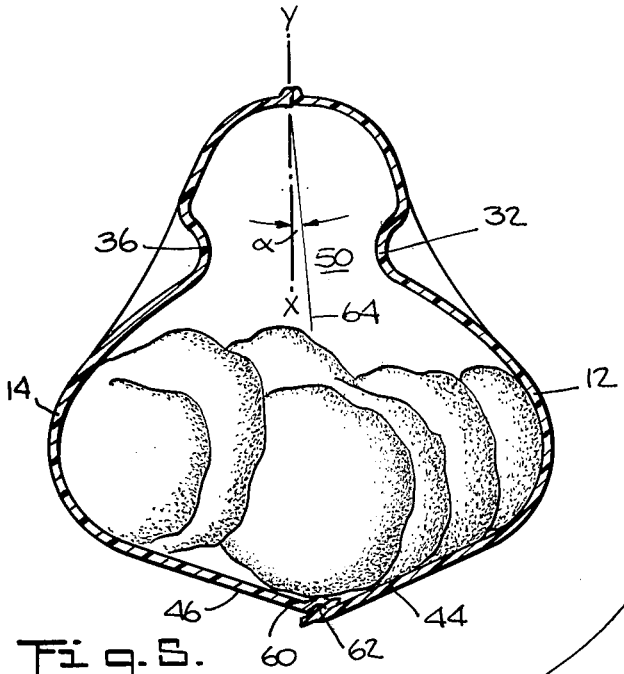
Fig. 5.
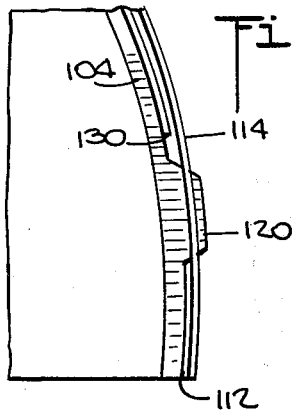
Fig. 8.
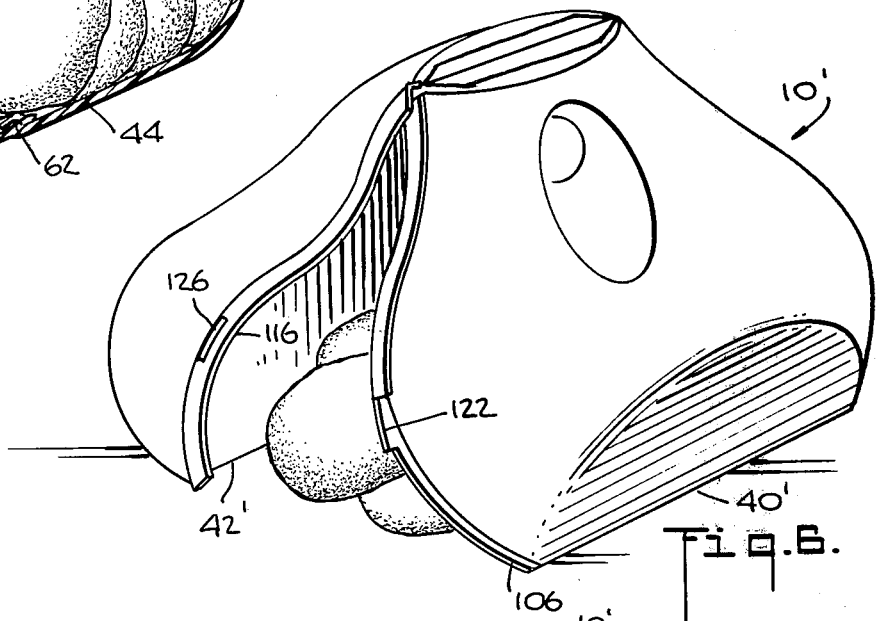
Fig. 6.
Fig. 7.
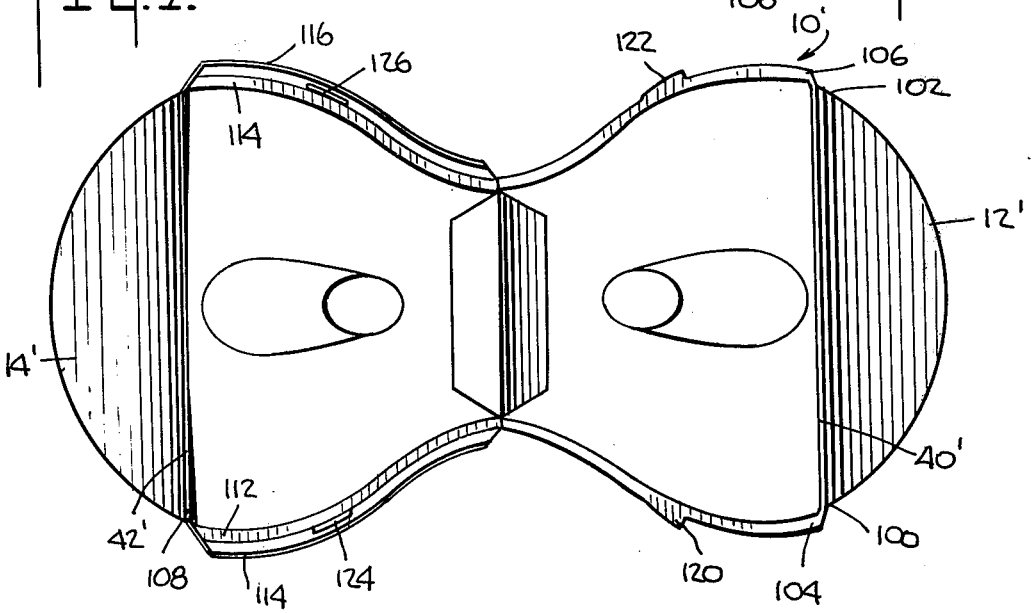

HAND OPERABLE SCOOP FOR THE COLLECTION AND DISPOSAL OF ANIMAL EXCREMENT

BACKGROUND OF THE INVENTION

1. Field of the Invention

This invention relates in general to a hand operable scoop and more particularly to a hand operable scoop which is especially suitable for the collection and disposal of animal excrement.

2. Prior Art

In the past few years there has been an increasing public concern regarding the problem of environmental pollution caused by the prevalent practice of animal pet owners permitting their animals to drop solid excrement in public areas. This problem is especially acute in urban areas where there is little wooded area or other unpopulated land where the presence of animal excrement would not cause a problem. The problem is compounded by the fact that notwithstanding this dearth of free space, the pet population in large urban areas continues to rise. Consequently a serious sanitation problem as well as an aesthetic problem exists.

In attempts to combat this problem, many communities have enacted ordinances which make pet owners liable to a fine for failure to clean up solid animal excrement left by their pets. Even in communities which do not have such local ordinances, many pet owners who have a sense of civic responsibility do undertake to clean up after their pets. Accordingly, there is a need to have a simple inexpensive easy to use scoop device which not only permits easy removal of excrement but also acts as a sanitary disposable container.

There have been several devices proposed for the collection and disposal of animal excrement or other unsavory material. For example, in U.S. Pat. No. 3,738,697 there is disclosed a portable collector apparatus which has a disposable container including hingedly connected halves releasably supported by tongs at the end of an extended cane-like handle. The tongs are closed by operating the slide rod within the handle and the tongs as they close swing the container halves closed about the solid excrement. A similar device is disclosed in U.S. Pat. No. 3,733,098 which apparatus includes a cane-like handle at the bottom of which is disposed a pair of jaws. A hand operated actuator at the top of the handle is connected to the jaws by a rod or cable. A disposable cardboard container is releasably held in the open jaws and when the jaws are closed the container is closed and locked in a closed position. A problem with both of these prior art devices is that they each have several cooperating elements and consequently are relatively expensive to manufacture. Another problem with each of these devices is that the container halves are located at the end of a cane-like member. In use, the container halves must be positioned about the material to be scooped up and must be held in this position as the container halves are closed. Under ideal conditions an individual can use two hands, one to steady the device, and the other to actuate the container closing mechanism. However, in actual use, the individual will have his animal on a leash which leaves only one hand free to both steady and actuate the device. Any slight movement of the individual's hand will seriously affect the positioning of the container halves. This problem is made more acute by the fact that the animal may be quite active or restless and will not stand still or sit while the individual is trying to scoop the material. In addition these devices must be carried around as walking canes by the individual as he walks his animal and consequently may be considered by him to be an unwanted accessory and as a result, the device will not be used.

In another prior art device as disclosed in U.S. Pat. No. 3,685,088 a paperboard scoop is provided which can be held in the user's hand. While this device is more compact than the aforementioned devices, it suffers from the drawback that it is formed from a flat paperboard sheet and consequently is structurely weak. Moreover, there are many joints and seams through which the animal excrement may seep.

It is towards elimination of these and other problems that the present invention is directed.

SUMMARY OF THE INVENTION

1. Purposes of the Invention

It is an object of the present invention to provide an effective, yet simple, means for scooping up and disposing of animal excrement.

Another object of the present invention is to provide a scoop device for animal excrement which will give sanitary protection to the hand of the user.

A further object of the present invention is to provide a scoop device which in its closed condition serves as a sealed container for the excrement contained therein.

A yet further object of the present invention is to provide a scoop device which is relatively inexpensive to manufacture.

A still further object of the present invention is to provide a portable device for scooping animal excrement.

Other objects of the present invention in part will be obvious and in part will become apparent as the description proceeds.

2. Brief Description of the Invention

Generally, the above and other objects of the present invention are accomplished by providing a disposable and sanitary device which both scoops up and forms a closed container for animal excrement until it can be disposed of in a suitable place. The device includes a pair of concave shell halves which are formed with smooth compound curved wall surfaces. Each of the shell halves has an upper portion and a lower portion which is larger than the upper portion. An integrally formed hinge means connects the shell halves at their respective upper portions in a normally biased open, i.e., spread apart configuration.

The upper portions of the shell halves are sized to be easily received in and encompassed by the hand of the individual using the device.

The larger lower portion on each scoop element terminates in a straight edge remote from the hinge means. The straight edge serves as a scraper to remove the excrement from a surface as the shell halves are moved together.

To enable the device to be operated in one hand, means are provided on each shell halve in close proximity to the integral hinge which is constructed and arranged to be engaged by a thumb or a finger. The shell halves may be urged toward each other from their normally open configuration to a closed configuration about animal excrement. The depressions preferably have a steep wall disposed towards the hinge means to enable the thumb and finger to more securely grasp the device.

In one embodiment when the shell halves are brought together into their closed configuration, the straight edge on the lower portion of one of the shell halves is telescopingly received within the lower portion of the other shell half to prevent leakage of the excrement from the container. Preferably locking means are provided along at least the straight edges to prevent the shell halves from accidentally opening. The container can then be disposed of in any suitable manner.

In an alternative embodiment, when the shell halves are brought together into their closed configuration, the straight edges on the lower portions of the shell halves do not telescope but abut or otherwise lie in close proximity to each other. Locking means disposed along the side edges of the shell halves prevent the shell halves from accidentally opening.

The invention consists in the features of construction, combination of elements and arrangement of parts which will be exemplified in the device and article of manufacture hereinafter described and of which the scope of application will be indicated in the appended claims.

BRIEF DESCRIPTION OF THE DRAWINGS

While the specification concludes with claims particularly pointing out and distinctly claiming the subject matter regarded as the invention herein, it is believed that the invention will be better understood from the following description when read in conjunction with the accompanying drawings, in which:

FIG. 1 is a perspective view showing the device of this invention held in the hand of the user and positioned in its open configuration over animal excrement deposited on a surface;

FIG. 2 is a top view of the device of the present invention in its closed condition;

FIG. 5 is a sectional view similar to FIG. 4 but showing the device in its closed configuration;

FIG. 6 is a perspective view showing an alternate embodiment of the device of the present invention positioned in its opened condition over animal excrement;

FIG. 7 is a bottom view of the embodiment shown in FIG. 6, with the shell halves in a partially closed condition; and FIG. 8 is a detailed view of the lock of the alternate embodiment.

DESCRIPTION OF THE PREFERRED EMBODIMENTS

Figure 3:
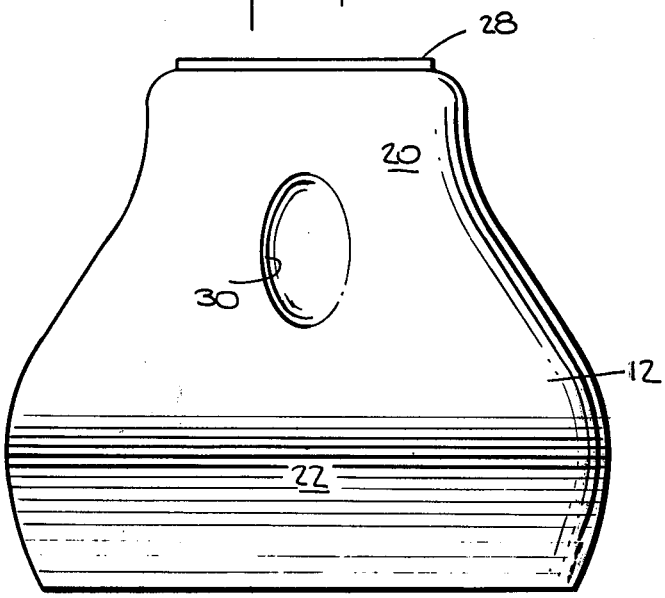
FIG. 3 is a front view of the device in its closed condition.

In FIG. 1 there is shown a device in accordance with one embodiment of the present invention which is identified generally by the reference numeral 10. The device 10 includes a first shell half 12 and a second shell half 14. The shell halves 12 and 14 are each formed with wall surfaces 16 and 18 respectively having a profile essentially that of smooth compound curves that are generated about two axes through the wall surfaces. It has been found that such a wall surface configuration, which may resemble gently curved pear shape halves provides for much greater strength than flat or cylindrical surfaces. The latter surface configurations have a tendency to buckle inwardly as the device is used to scoop animal excrement or other unsavory matter as will hereinafter be described.

With continued reference to FIG. 1, the first shell half 12 includes an upper portion 20 and a lower portion 22. The lower portion 22 is larger in size than the upper portion 20. Similarly the second shell half 14 includes an upper portion 24 and a larger lower portion 26.

The first shell halves 12 and 14 are hingedly connected to their upper portions 20 and 24 respectively by means of an integral hinge means 28.

For disposability and expedience, the device 10 may be molded from one piece of cardboard, paper mache, plastic or any other suitable material with the shell halves in a biased open, i.e., spread apart configuration. In the fully open container state the shell halves 12 and 14 are spread substantially 180° apart about a pivot axis defined by the hinge means 28. In this manner the devices may be nested one on top of the other to save space when they are packaged for sale.

The hinge means 28 is constructed to bias the shell halves into their open configuration so that, when the device is used in the manner hereinafter set forth, the user can have a greater control over the closing of the shell halves. In this way, the user can easily open the partially closed shell halves which will be biased against his fingers, until they are closed and locked as described below.

Figure 4:
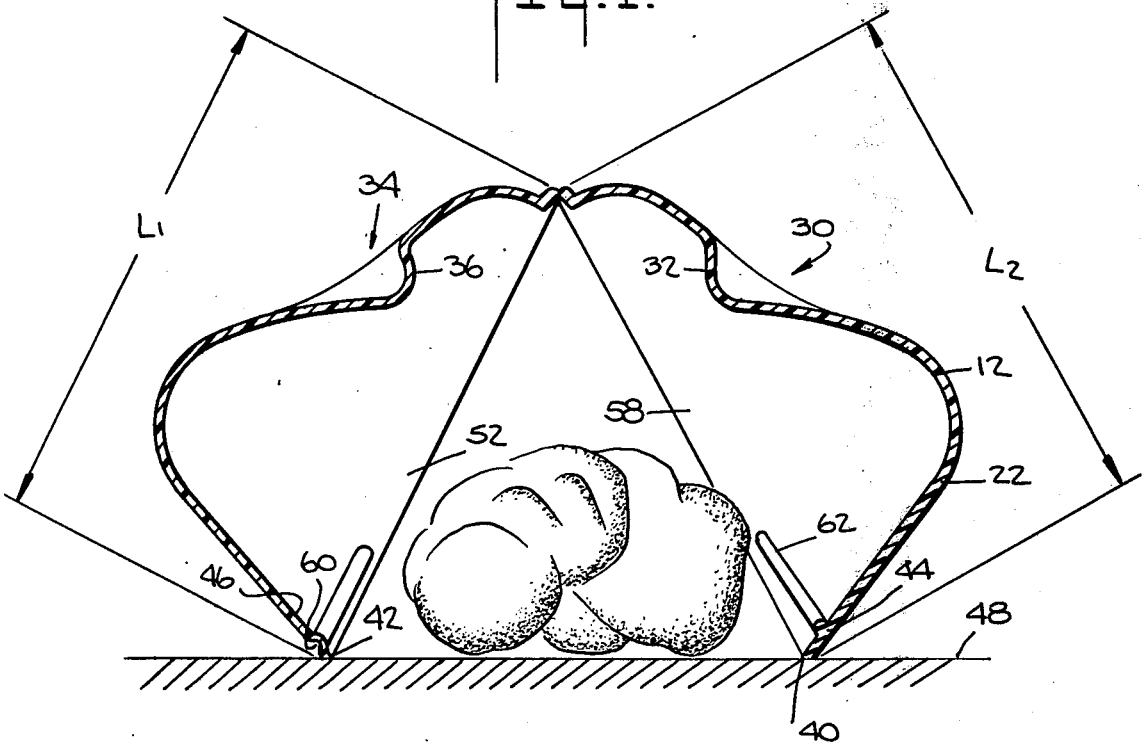
FIG. 4 is a sectional view taken substantially along the line 4—4 of FIG. 1.

Means are provided on each of the shell halves to permit the device to be held securely in the hand of an individual and manipulated to serve the scooping function. There is provided on the first shell half 12 an elongated depression 30 which is oriented substantially perpendicular to the hinge means 28. As can best be seen in FIGS. 4 and 5, the depression 30 is provided with a steep wall portion 32 which serves as a bearing surface against which the user may apply pressure through his thumb or finger to close the container. A similar depression 34 having a steep wall 36 is likewise oriented substantially perpendicularly to the hinge 28 on the second shell half 14.

To use the device, an individual positions the first and second shell halves 12 and 14 in his hand so that his thumb 38 is received in depression 30 and a finger 39 is received within the depression 34. Obviously, the positioning of the thumb and finger may be reversed. The device which will be in its normally open configuration is then positioned over a deposit of animal excrement or other unsavory matter which is to be collected and removed from the ground or other surface. The user then moves his thumb and finger toward each other which results in the first and second shell halves 12 and 14 moving toward each other. As the shell halves are so displaced, the straight beveled edges 40 and 42 located at the edge areas 44 and 46 of the lower portions 22 and 26 respectively scrape along the surface 48 and thereby collect or lift the excrement into the shell halves. When the scoop elements 12 and 14 have been manipulated into their closed configuration (FIG. 5) the animal excrement will be scooped up and contained within the hollow chamber 50 formed by the closed shell halves.

The device is self-locking upon closure so that the container is sanitary and will not accidentally open and discharge its contents. With continued reference to FIG. 4, it can be seen that the edge area 46 on the second shell half 14 is telescopingly received within the first shell half 12. The side portions 52 and 54 are likewise telescopingly received in the first shell half. To this end, the overall length $L_1$ of the second shell half 14, i.e., the distance from the centerline of the hinge means 28 to the edge 42, is slightly less than the overall length $L_2$ of the first shell half 12. Preferably the difference between $L_1$ and $L_2$ is the wall thickness of the shell half. As noted hereinabove, the side portions 52 and 54 of the second shell half are also telescopingly received in the first shell half 12. To accomplish this, the width $W_1$ of the second shell half 14 measured from the external side surfaces 55 and 56 as shown in FIG. 2, is less than the width $W_2$ of the first shell half 12 measured from the internal side surfaces 57 and 58. Preferably, the difference is approximately twice the wall thickness of the first shell half 12 so that the second shell half 14 can easily fit within the first shell half 12. There is provided adjacent the edge 42 a depression or groove 60 which runs along the entire length of and is parallel to the edge 40. The depression 60 may continue as well upwardly along the sides 52 and 54 of the second shell half 14 as shown. Located adjacent the edge portion 44 on the second shell half 12 is a ridge 62 which extends along the length of and is parallel to the edge 42. If the depression 60 extends upwardly on the sides of the second shell half 14, the ridge 62 extends upwardly along the side surfaces 57 and 58 of the first shell half 12. The groove 60 is constructed and arranged to receive the ridge when the edge area 46 is telescopically received in the first shell half 12 to lock the shell halves in their closed configuration to form a sanitary disposable container. As best seen in FIG. 5, in this condition, the edge 64 of the second shell half 14 lies beyond the vertical axial centerline of the container indicated by the line X-Y and may be offset therefrom at an angle $\alpha$ of 6° as shown.

An alternative embodiment of the present invention is illustrated in FIG. 6 and identified as 10'. The device 10', except as described below, is identical to the device 10, and for the sake of brevity, will not be described in detail. Where reference is made to elements described hereinabove, a prime will accompany the reference numeral. The device 10' includes two shell halves 12' and 14' which may be held together by the integral hinge 28 (not shown in FIG. 6) but shown and described in reference to the first embodiment discussed, or by means of a flexible hinge member 28' which may be reinforced tape adhered to the inner and outer surfaces of the shell halves 12' and 14'.

The device 10' functions in a manner identical to the device 10, however, it differs therefrom in the configuration of the shell half straight edges and the locking means. As shown in FIG. 6, the first shell half 12' has disposed along its side edges 100 and 102 outwardly extending ribs 104 and 106 respectively. The second shell half 14' has disposed along its side edges 108 and 110 outwardly extending ribs 112 and 114 which are turned at portions 114 and 116 respectively towards the first shell half 12' as shown.

When the shell halves 12' and 14' are moved into their closed configuration, the ribs 104 and 106 abut the ribs 112 and 114. In addition, the tabs 120 and 122 on the ribs 104 and 106 respectively will be received in slits 124 and 126 in the upturned positions 114 and 116 as shown in FIG. 7. Obviously, as the shell halves are brought together, the tabs 120 and 122 and or the upturned positions 114 and 116 will deform slightly to allow the tabs to pass beyond the leading edges of the upturned portions and be seated in the slits. When the tabs are received in the slits the edges 40' and 42' on the shell halves 12' and 14' will be abutting or in close proximity to each other.

As shown in FIG. 7, the rib may have an upturned portion 130 which extends away from the second shell half 14' and which cooperates with the upturned portion of the rib to help make the device more rigid when the shell halves are in the closed configuration as well as to help in seating properly, the tabs in the cut outs. The other rib 106 may likewise be provided with such a portion to cooperate with the upturned portion 116.

It can thus be seen that the objects of the present invention, namely, to provide a device for the collection and disposal of animal excrement, have been accomplished by hingedly connecting two shell halves, each of which has a pear-like convex shape and further has an upper portion and a lower portion which is somewhat larger than the upper portion. The shell halves are hingedly connected so that their upper portions lie adjacent one another. The upper portions are sized so as to be received comfortably within the hand of the user.

Means are provided on each of the shell halves to receive either the thumb or finger of the user. The thumb and finger receiving means are in the form of elongated depressions oriented substantially perpendicularly to the hinge means and having a bearing surface upon which force may be applied to the respective shell half.

To use the device the shell halves which are biased into an open configuration so that they lie approximately 180° apart along the axis formed by the hinge means are positioned over the material to be collected and the shell halves are then urged toward each other. Each of the lower portions of the shell halves is provided with a substantially straight edge which serves to scrape the material from the ground into the shell halves as the shell halves move toward each other. When the shell halves are in their closed configuration the material to be collected will be enclosed within the shell halves. To ensure that the shell halves will remain in their closed configuration to prevent the material collected from accidentally escaping from the container, the edge of one of the shell halves may be telescopingly received within the edge of the other of the shell halves and a self-locking means is provided to secure the container against spillage. The locking means includes a groove-like structure on that portion of the shell halves which is received in the other of the shell halves. A mating ridge is provided on the other of the shell halves and is constructed and arranged so as to engage the groove when the one edge is telescopically received in the other shell half.

Alternatively, the straight edges may abut each other when the shell halves are in the closed configuration and the shell halves may be held in this configuration through the cooperation of tabs on the side edges of one of the shell halves which are received in slits on the side edges of the other of the shell halves.

While in accordance with the patent statutes preferred embodiments of the present invention have been illustrated and described in detail, it is to be particularly understood that the invention is not limited thereto or thereby.

What is claimed is:

1. A hand operable scoop for collecting and disposing of animal excrement comprising:

(a) a pair of concave shell halves each formed with smooth compound curving wall surfaces, said curves generated about two axes throughout said wall surfaces, each of said shell halves having a smaller upper portion and a lower portion larger than said upper portion, said smaller portions sized to be easily received in and encompassed by the hand of a user;

(b) an integral hinge means connecting said pair of shell halves at their respective upper portions;

(c) straight edges disposed on said lower portion remote from said hinge means;

(d) finger receiving means disposed on each of said shell halves so that said shell halves may be manipulated about said hinge means from an open configuration to a closed configuration about animal excrement, while said straight edges scrape said animal excrement into said shell halves; and (e) locking means disposed on said shell halves to lock said shell halves in their closed configuration to form a sealed container.

2. The hand operable scoop in accordance with claim 1 wherein said finger receiving means comprises elongated depressions on each of said shell halves which depressions are oriented substantially perpendicularly to said hinge means and bearing surfaces within each of said depressions constructed and arranged to engage said fingers so that said shell halves may be manipulated through corresponding manipulation of said fingers.

3. The hand operable scoop in accordance with claim 1 wherein said first and second shell halves are biased into said open configuration whereby said shell halves are urged against the fingers of the user as said first and second shell halves are manipulated into their closed configuration.

4. The hand operable scoop in accordance with claim 1 wherein said straight edges are in telescoping relationship when said first and second shell halves are closed and said locking means is adjacent at least said straight edge.

5. The hand operable scoop in accordance with claim 1 wherein said straight edges are in abutting relationship when said first and second shell halves are closed and said locking means is disposed on the side edges of said first and second shell halves.

* * * * *